United States Patent [19]

Funke et al.

[11] 4,103,975

[45] Aug. 1, 1978

[54] MINING MACHINE PARTICULARLY A DRUM-CUTTER MINING MACHINE

[75] Inventors: Wilhelm Funke; Heinrich Honke, both of Bochum, Fed. Rep. of Germany; Heinz Simonides, deceased, late of Bochum, Fed. Rep. of Germany, by Charlotte Simonides, executrix

[73] Assignee: Gebr. Eickhoff, Maschinenfabrik und Eisengiesserei m.b.H., Bochum, Fed. Rep. of Germany

[21] Appl. No.: 707,534

[22] Filed: Jul. 22, 1976

[30] Foreign Application Priority Data

Jul. 23, 1975 [DE] Fed. Rep. of Germany ..... 2532893

[51] Int. Cl.[2] ..... E21C 29/22

[52] U.S. Cl. ..... 299/43; 105/29 R

[58] Field of Search ..... 299/42, 43; 105/29 R

[56] References Cited

U.S. PATENT DOCUMENTS

| | | | |
|---|---|---|---|
| 849,432 | 4/1907 | Sperry | 105/29 R |
| 991,954 | 5/1911 | Charbonneau | 105/29 R |
| 1,027,073 | 5/1912 | Sessions | 105/29 R |
| 1,558,893 | 10/1925 | Kjelsberg | 105/29 R |
| 1,711,280 | 4/1929 | Morgan | 299/42 |
| 3,753,596 | 8/1973 | Pentith | 299/43 X |

FOREIGN PATENT DOCUMENTS

| | | | |
|---|---|---|---|
| 1,240,914 | 5/1967 | Fed. Rep. of Germany | 105/29 R |

*Primary Examiner*—Ernest R. Purser
*Assistant Examiner*—William F. Pate, III
*Attorney, Agent, or Firm*—Thomas H. Murray

[57] ABSTRACT

A drum-cutter mining machine is propelled along a course of travel at the working face of a mine by a winch carried on the machine. The winch drives two sprocket wheels each pivotally carried by a pivot arm to position the sprocket wheels so that their teeth mesh with the teeth of a stationary rack. A roller or skid runner is carried by each arm to engage the lower surface of the rack and maintain the desired meshing relation between the sprocket wheel and the rack teeth at the upper surface of the rack. In a second embodiment, single-acting piston and cylinder assemblies deliver a biasing force to opposite sides of a level coupled to each pivot arm for controlling its position in a dependent relation to the direction of travel by the mining machine along the rack.

10 Claims, 5 Drawing Figures

MINING MACHINE PARTICULARLY A DRUM-CUTTER MINING MACHINE

BACKGROUND OF THE INVENTION

This invention relates to a mining machine and more particularly to a drum-cutter mining machine having at least one sprocket wheel drivingly coupled with a winch while the teeth of the sprocket wheel mesh with teeth of a rack extending along the length of travel by the mining machine.

It is known in the art to provide a drum-cutter mining machine with two sprocket wheels for a drive winch carried by the machine to engage from above a flat-link chain extending along the length of the mine face. A trough with an open top extends along the working face at the side wall of a face conveyor to receive the flat-link chain while a resilient extension from the mining machine extends beneath the chain to insure engagement with the sprocket wheel.

It is also known in the art to provide a rack at the stow side of a face conveyor for engagement with a sprocket of a winch drive carried on a chain drum cutter mining machine to produce the desired advancing movement by the machine along the mine face. However, a proper meshing relation with the sprocket wheel carried on the mining machine cannot always be obtained when the mining machine has a substantial length and moves along a mine floor that is undulating. More particularly, peaks or troughs to the mine floor adversely affect engagement with the sprocket wheel since the mining machine is carried by support skids located at opposite ends of the machine. The usual face conveyor associated with the mining machine is subdivided into relatively short adjoined sections and adaptable to the undulating course of the floor. However, the mining machine, having a structural length which may be 7 meters or greater in length, is not adaptable to the undulating course of the floor. This is because the support skids situated at opposite ends of the machine span a distance whereby four or more conveyor trough sections are bridged by the body of the mining machine. The vertical position of the driven sprocket wheel situated at the longitudinal center of the mining machine cannot be maintained in constant engagement with a rack or flat-link chain because of the constant varying vertical position of the chain or rack relative thereto. When a rack is employed, it is divided into sections and mounted onto the side wall of the face conveyor so that the driven sprocket wheel can produce the desired advancing movement of the mining machine by engaging the rack.

SUMMARY OF THE INVENTION

It is an object of the present invention to arrange one or more drive sprocket wheels on the machine body of a mining machine in a manner such that the sprocket wheel or wheels automatically maintain a meshed relation with a rack extending along the course of travel by the mining machine irrespective of the vertical position thereof.

Thus, according to the present invention, there is provided in combination with a mining machine having a winch coupled to a sprocket wheel for propelling the mining machine along a course of travel at the working face of the mine, an apparatus including the combination of an elongated rack extending along the course of travel by the mining machine, the rack having teeth at spaced-apart locations along the length thereof, at least one support arm carried by the mining machine to pivot about a horizontal axis that extends at right angles to the course of travel by the machine, the support arm carrying the sprocket wheel for pivotal movement about the horizontal axis, and means carried by the support arm to position and maintain a meshed relation between the sprocket wheel and the teeth of the rack for transmission of a force to propel the mining machine along the rack.

Thus, the present invention provides that a sprocket wheel is carried by a support arm on a mining machine for pivotal movement about a horizontal axis of a winch drive on the machine, which axis is situated at right angles to the direction of traversing movement by the machine. The pivot arm is adapted to grip beneath a rack or a guide rail extending parallel thereto to insure proper engagement between the teeth of the sprocket wheel and the teeth of the rack. The sprocket wheel is guided by the support arm for contact with the rack and, therefore, accurately follows the position of the rack along the extended length thereof. Spacing changes between the machine body and the rack which occur when the mine floor undulates, do not impair tooth engagement between the sprocket and the rack. Moreover, the desired tooth engagement is not impaired by vertical differences which can occur at the joints between rack sections arranged end-to-end to form the rack extending along the length of travel by the mining machine.

According to a further embodiment of the present invention, the winch on the mining machine is equipped with two support arms preferably inclined at opposite directions and arranged on the same side of the mining machine. The center distance between the sprocket wheels carried by the support arms is selected so that it does not correspond to the length of any single rack section used to form the rack. The center distance between the sprocket wheels is selected so that one of the two sprocket wheels is always situated over a rack section while the other sprocket wheel is passing over a joint between adjoined rack sections. The mining machine is pushed by a sprocket wheel situated behind the pivot axis of a support arm in relation to the direction of propelled movement of the mining machine. The mining machine is drawn by the sprocket wheel positioned ahead of the pivot shaft by the support arm in relation to the direction of movement by the machine.

Advantageously, the support arm includes means to grip the rack beneath it or beneath a guide rail extending parallel to the rack. Such means may take the form of a roller, preferably situated in the same vertical plane as the axis of the sprocket wheel. The roller guides the support arm without incurring large frictional forces. Any vertical differences which occur at the joints between individual rack sections and the plane of symmetry of a sprocket wheel are compensated for by pivotal movement of a support arm whereby an appropriate correction is effected to the position of the sprocket wheel. As an alternative to using the aforementioned roller, a skid runner may be employed having curved guide surfaces facing the rack or guide rail for guiding the free end of the support arm as well as the sprocket wheel. When a skid runner is employed, it is desirable to further provide two thrust jacks arranged to operatively engage the support arm to relieve the skid runner of thrust forces. The thrust jacks are biased in regard to the forces generated in a dependent relation to the direction of travel by the mining machine. The direction and magnitude of the forces generated by the two thrust jacks are always biased so that a radial force acting on the sprocket wheel is substantially canceled and, therefore, the frictional forces occurring between the skid runner and the rack or guide rail are reduced. According to a further feature of the present invention, the two thrust jacks are connected to opposite sides of a hydraulic control circuit associated with the winch drive so as to bias the winch drive in a dependent relation to the direction of travel by the mining machine which also reduces radial loading upon the sprocket wheel. The pull of the winch and the biasing thrust by the jack in this instance depend upon each other so that an increase to the pull by the winch and the larger radial forces resulting therefrom cause an increase to the biasing thrust applied to the support arm to counteract the radial forces.

These features and advantages of the present invention as well as others will be more fully understood when the following description is read in light of the accompanying drawings, in which.

Figures 1, 2:
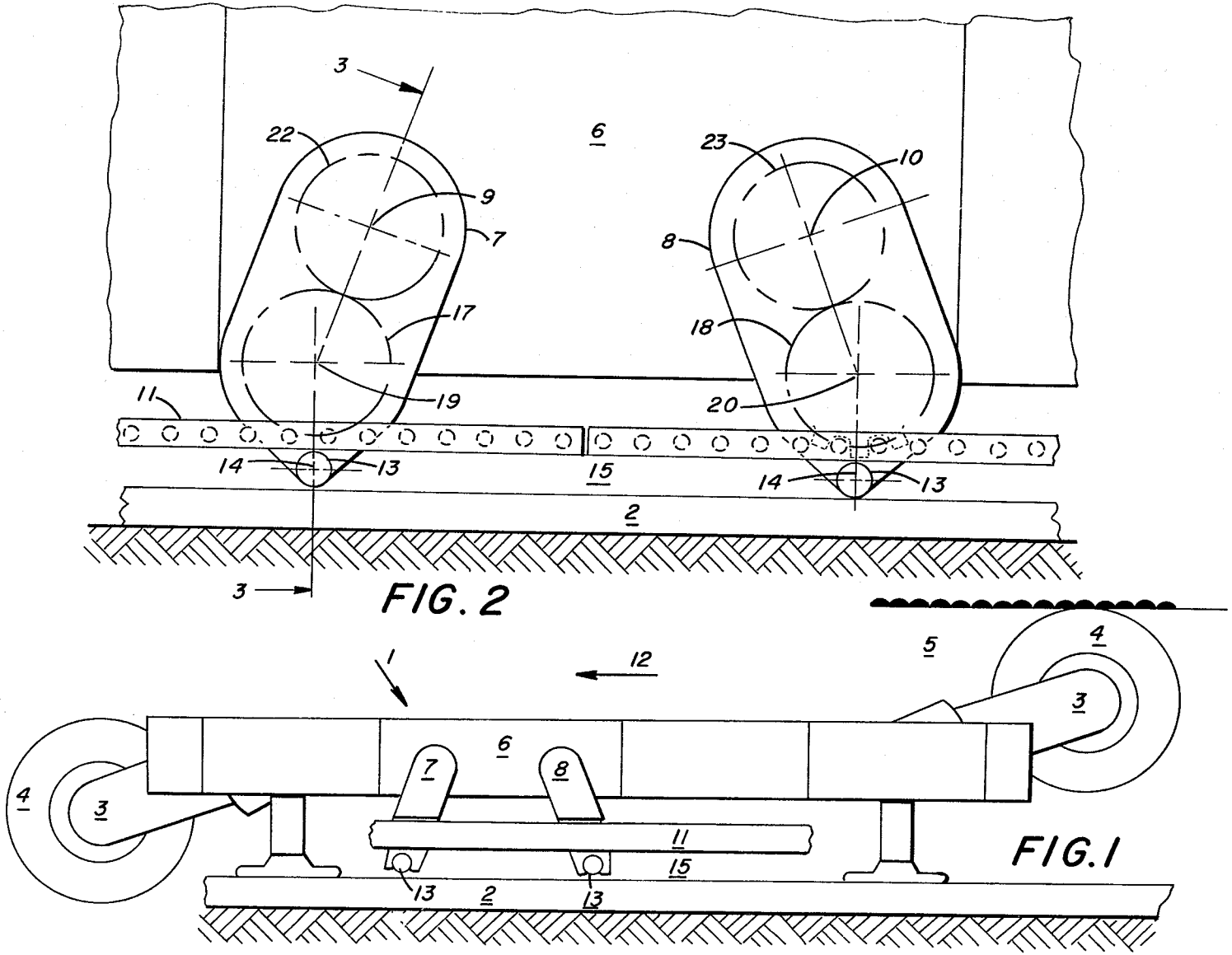
FIG. 1 is a side elevational view of a drum-cutter mining machine including the apparatus of the present invention.
FIG. 2 is an enlarged view of the apparatus including the pivotal support arms shown in FIG. 1.

In FIG. 1, there is illustrated a drum-cutter mining machine 1 traversable upon a face conveyor 2 to release or cut material from a mine face 5 by means of cutting drums 4 supported by pivotal support arms 3. In accordance with the present invention, the mining machine includes a winch 6 having two laterally-spaced support arms 7 and 8. The support arms are carried by the drum-cutter mining machine specifically by the winch 6 for pivotal movement about axes 9 and 10, respectively. The axes 9 and 10 are parallel and extend at right angles to movement by the mining machine along the face conveyor 2 which extends parallel with the mine face 5. A rack 11 is mounted onto the side wall of the face conveyor 2. The rack consists of rack segments or sections arranged in an end-to-end relation to extend along the direction of travel by the mining machine. The support arms 7 and 8 extend downwardly from the winch so as to form an acute angle with the horizontal plane of the rack. These support arms can be arranged parallel to each other or they can be inclined downwardly in opposite directions so that their projected ends near rack 11 lead and/or trail with respect to the pivot axes 9 and 10 of the support arms in relation to the direction of movement 12 by the mining machine.

Figure 3:
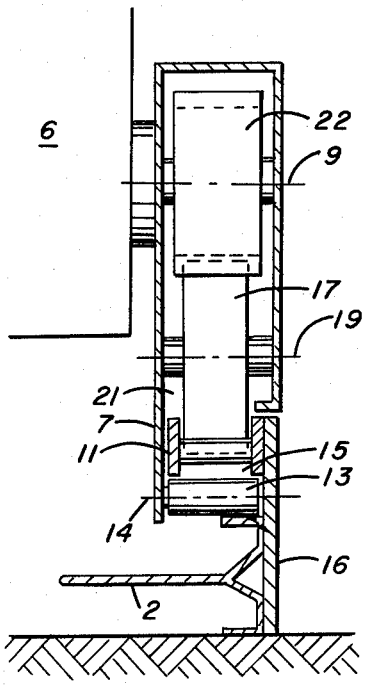
FIG. 3 is a sectional view taken along line III—III of FIG. 2.

In the embodiment of the present invention illustrated in FIGS. 2 and 3, both support arms 7 and 8 grip beneath the rack 11 by means of rollers 13. Each roller 13 is carried by a support arm so as to be rotatable about the rotational axis 14 of the roller. The rollers 13 engage within a trough or duct 15 formed by the face conveyor 2 and the rack 11 disposed thereabove. The rollers 13 are situated in the vertical planes of symmetry of the sprocket wheels 17 and 18. In this way, the rotational axis 14 of a roller 13 lies in a vertical plane passing through the rotational axis of a sprocket 17 or 18. The duct 15 within which the rollers 13 move is closed on the stow side by a wall 16 employed to connect the rack 11 onto the side wall of the face conveyor 2. The projected ends of support arms 7 and 8 are free to pivot about axes 9 and 10 but are constrained to a positive pivotal movement because of the connection between rollers 13 and the rack whereby the sprocket wheels 17 and/or 18 are positioned to follow in a meshed relation with the teeth of the rack along the extended length of the rack. Sprocket wheels 22 and 23 are mounted onto drive output shafts of winch 6. These sprocket wheels are enclosed within the support arms 7 and 8 together with the sprocket wheels 17 and 18, respectively. The sprocket wheels 17 and 18 are carried by the support arms so as to rotate about axes 19 and 20. As shown in FIGS. 2 and 3, support arms 7 and 8 each takes the form of an enclosing-type housing, with an opening 21 at its lower end wherein the teeth of the rack 11 project for meshing engagement with the teeth of the sprocket wheel. The sprocket wheels 22 and 23 are supported so that they rotate about the pivot axes 9 and 10, respectively, which correspond to the axes of the drive output shafts of the winch 6. Sprocket wheels 22 and 23 transmit the driving force from the winch to sprocket wheels 17 and 18 which are, in turn, in meshing engagement with the teeth of the rack 11. Both support arms 7 and 8 are dimensioned so that the center distance between the sprocket wheels 17 and 18 differs from the length of a rack section forming part of the rack 11 so that at least one of the two sprocket wheels 17 or 18 meshes with the teeth of the rack.

Figure 5:
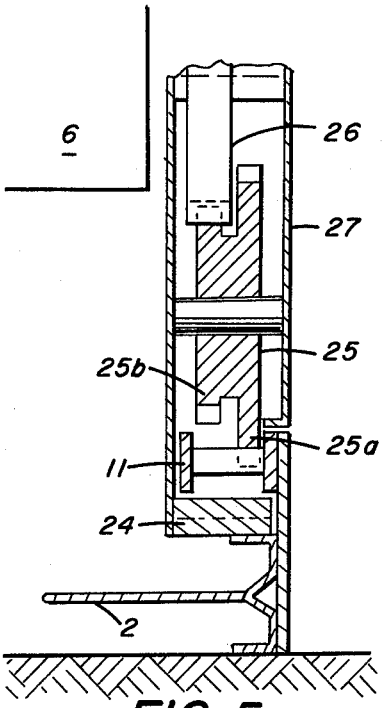
FIG. 5 is s sectional view taken along line V—V of FIG. 4.
Figure 4:
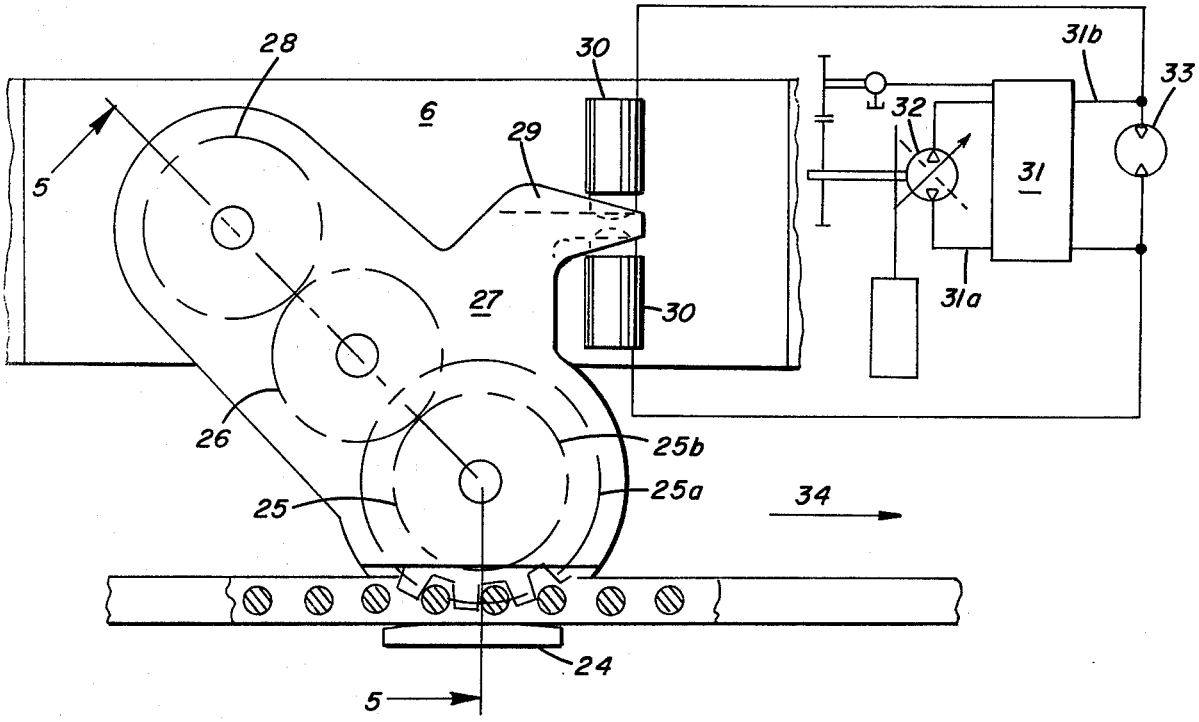
FIG. 4 is a second embodiment of the present invention as illustrated by an elevational view corresponding to FIG. 2.

As illustrated in FIGS. 4 and 5, in the second embodiment of the present invention the support arms 7 and 8 are also provided with members to engage the underside of the rack 11. These members are in the form of skid runners 24 each of which has a guide surface extending from a curved leading and trailing surface at the underside of the rack to facilitate traversing movement of the skid runner across a joint between rack sections. In this embodiment of the present invention, a sprocket wheel 25 includes two coaxially-arranged gear rims 25A and 25B. The gear rim 25A meshes with the teeth of the rack 11 and gear rim 25B meshes with an intermediate gearwheel 26 carried by a support arm 27 to transmit torque from a gearwheel 28 which is, in turn, secured to the output shaft of the winch 6 carried on the mining machine. Two single-acting thrust jacks 30 which preferably take the form of piston and cylinder assemblies, are mounted onto the side wall of the casing forming part of the winch 6. The thrust jacks 30 are situated on opposite sides of an extension 29 projecting from the support arm 27. The cylinder members of the thrust jacks 30 deliver a force produced by the transmission of fluid from opposite sides of a control circuit 31 forming part of the hydraulic system for the winch 6. The thrust jacks 30 deliver a force to opposite sides of the extension 29 which is located at the approximate longitudinal middle portion of the support arm 27. Depending upon the direction of transverse motion by the drum-cutter mining machine 1, either the hydraulic line 31A or the hydraulic line 31B of the hydraulic control circuit is biased in regard to the fluid pressure therein by a fluid pump 32 used to drive through a stepdown transmission, not shown, the winch 6. This drive includes a hydraulic motor 33 for providing a drive for the sprocket wheel 25. When the drum-cutter mining machine 1 moves along in the direction of arrow 34 and when the support arm 27 is in the illustrated sloped position, the guide surface on the skid runner 24 is pressed against the bottom edge of rack 11 under the influence of the forces developed by the meshing relation between the teeth of the sprocket wheel and the teeth of the rack. When the drum-cutting mining machine 1 traverses in the opposite direction, the sprocket wheel 25 is thrust against the rack 11 under the influence of the forces exerted between the meshing teeth of the sprocket wheel and rack. Radial force loadings upon the sprocket wheel 25 produced by the tooth pressures are relieved by the two thrust jacks 30. The thrust jacks are, therefore, connected to the hydraulic fluid-control lines 31A and 31B so that when the drum-cutting mining machine 1 moves in the direction of arrow 34, the thrust jack 30 above the extension 21 is biased by the control circuit 31 with a fluid pressure which is proportional to the tooth pressure. When the mining machine is traversed in the opposite direction, the thrust jack 30 below the extension 29 is biased to provide a pressure corresponding to the tooth pressure.

The drum-cutter mining machine 1 in both embodiments of the present invention may, if desired, be provided with support arms 7, 8 or 27 at the stow side and/or on the working side of the machine. The sprocket wheels 17, 18 or 25 carried by the support arms arranged in this manner will remain in the previously-described meshed relation with the rack 11 extending below the support arm.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In combination with a mining machine having a winch for propelling the mining machine along a course of travel at the working face of the mine upon a face conveyor, each end of the mining machine including a pivotal support arm that carries a drum cutter to release coal from said working face for transportation by said face conveyor, an apparatus including the combination of:

wheel means coupled for rotation by said winch, a sprocket wheel driven by said wheel means, an elongated rack extending along said course of travel by the mining machine, said rack having teeth at spaced-apart locations at the top along the length thereof, at least one support arm carried by said mining machine to pivot about a horizontal axis that extends at right angles to the course of travel by the mining machine, said support arm pivoting at one end thereof about said horizontal axis and said support arm positioning said sprocket wheel at the other end thereof to mesh with the teeth at the top of said rack by pivotal movement of the support arm about said horizontal axis, and support means extending from said support arm beneath the teeth of said rack to position and maintain a meshed relation between said sprocket wheel and the teeth of said rack during the transmission of forces to the rack to propel the mining machine therealong.

2. The apparatus according to claim 1 wherein two support arms are carried at spaced-apart locations at the same side of said mining machine, each support arm carrying a sprocket wheel to mesh with the teeth of said rack for transmission of a force to propel the mining machine along the rack.

3. The apparatus according to claim 2 wherein said two support arms extend downwardly from the mining machine at an angle opposite each other.

4. The apparatus according to claim 2 wherein said rack includes a plurality of rack segments arranged in an end-to-end relation to extend along the course of travel by the mining machine, each rack segment having a length essentially different from the space between the said two support arms.

5. The apparatus according to claim 1 wherein said support means includes a roller carried by said support arm to extend beneath and engage said rack for maintaining said meshed relation between said sprocket wheel and the teeth of the rack at the opposite side thereof.

6. The apparatus according to claim 5 wherein the rotational axis of said roller lies along a vertical plane passing through the axis of rotation of said sprocket wheel.

7. The apparatus according to claim 1 wherein said support means includes a skid runner having a curved guide surface at the opposite ends thereof, said skid runner engaging a side of said rack opposite said sprocket wheel for maintaining a meshed relation between the sprocket wheel and the teeth of the rack.

8. The apparatus according to claim 1 further including thrust members coupled to said support arm to control the position of said support means in a dependent relation to the direction of travel by the mining machine relative to said rack.

9. The apparatus according to claim 1 further including two thrust jacks coupled to said support arm to bias the position of said support means in a dependent relation to the direction of travel by the mining machine relative to said rack.

10. The apparatus according to claim 9 further including fluid-control means having fluid-conducting lines separately coupled to each of said thrust jacks.

* * * * *